US007819242B1

(12) United States Patent
Sanburn

(10) Patent No.: US 7,819,242 B1
(45) Date of Patent: Oct. 26, 2010

(54) MEDICAMENT DELIVERY DEVICE

(76) Inventor: Craig Sanburn, 1024 Bancroft Rd., Concord, CA (US) 94518

( * ) Notice: Subject to any disclaimer, the term of this patent is extended or adjusted under 35 U.S.C. 154(b) by 0 days.

(21) Appl. No.: 12/584,472

(22) Filed: Sep. 5, 2009

(51) Int. Cl.
*A45C 15/00* (2006.01)
*B65D 83/04* (2006.01)

(52) U.S. Cl. ..... 206/38; 206/532; 206/37; 70/456 R

(58) Field of Classification Search ..... 206/38, 206/38.1, 37, 37.1, 37.3, 37.4, 528, 532, 206/536; 70/459, 456 R, 336, 344
See application file for complete search history.

(56) References Cited

U.S. PATENT DOCUMENTS 5,313,376 A * 5/1994 McIntosh ..... 362/119
5,529,172 A * 6/1996 Laughlin ..... 206/38.1
5,782,024 A * 7/1998 Pausch ..... 40/330
6,351,903 B1 * 3/2002 Tuomi ..... 40/634
6,962,253 B1 * 11/2005 McZeek ..... 206/37

* cited by examiner

*Primary Examiner*—Jacob K Ackun, Jr.
(74) *Attorney, Agent, or Firm*—Theodore J. Bielen, Jr.

(57) ABSTRACT

A medicament delivery device utilizing a housing having a chamber formed by a wall portion. The wall portion includes a weakened zone. A key shaft extends into the chamber and includes a portion lying outside the chamber or mating with a lock. The portion of the key shaft within the chamber serves as a support for a holder of a medicament. The medicament holder becomes accessible when a force is applied to the key shaft causing the same to egress from the chamber through the weakened zone of the wall portion.

11 Claims, 2 Drawing Sheets

MEDICAMENT DELIVERY DEVICE

BACKGROUND OF THE INVENTION

The present invention relates to a novel and useful medicament delivery device.

It is often imperative that a drug or chemical treatments be taken by an individual during medical emergencies. For example, a heart attack, stroke, and the like are best treated by the immediate taking of a medicament.

In case of a heart attack, chest pain, shortness of breath, nausea, chest pressure and the like may indicate symptoms of the same. It has been recommended that heart attack victims immediately may take medicament such as aspirin, nitroglycerine, and other oral drugs.

Failure to immediately ingest medicaments during a heart attack can lead to ventricular fibrillation and sudden death.

In the past, persons susceptible to a heart attack have carried emergencies medicaments in container which are often misplaced or kept in inconvenience places. For example, a person may place medicaments in a locked glove compartment of a car.

A system of immediately delivering of medicament during an emergency medical situation would be a notable advance in the medical arts.

BRIEF SUMMARY OF THE INVENTION

In accordance with the present invention a novel and useful medicament delivery device is herein below described.

The device of the present invention utilizes a housing which includes a wall portion forming an inner chamber. The wall portion also includes a weakened zone. The housing may be formed of any suitable rigid or semi-rigid material such as polymeric plastic, metal, wood and the like.

A key shaft is also employed in the present invention. The key shaft possesses a first end portion and a second end portion. The key shaft first end portion is accessible outside the housing chamber and, generally, is employed to open locks by having the proper cut and shape. The key shaft second end portion lies within the chamber adjacent the weakened zone of the wall portion which forms the chamber. The second end portion of the key shaft at least partially positions in the housing chamber. The key shaft second end portion may further include an end which extends from the housing chamber and includes an aperture to attach the device of the present invention to a key ring or similar item.

A holder is also found in the present invention and positions adjacent to or is connected to the key shaft second end portion lying within the housing chamber. The holder may take the form of a capsule that is translucent and is capable of storing the medicament. Likewise, the capsule may be breakable to allow easy access to the medicament. In addition, one or more flanges may be formed on either side of the holder capsule to maintain the position of the capsule relative to the second end portion of the key shaft.

After assemblage of the device of the present invention, a force upon the key shaft moves the key shaft and attached capsule through the weakened portion of the wall of the chamber, causing egress of the same from the housing chamber. At this point, the capsule is accessible for obtaining and employing the medicament found in the capsule. In this regard, one of the flanges lying adjacent to the capsule may be rotatable to permit removal of the capsule from its position on the second end portion of the key shaft.

It may be apparent that a novel and useful medicament delivery device has been herein above described.

It is therefore an object of the present invention to provide a medicament delivery device which permits the rapid recovery of a medicament in an emergency medical situation.

Another object of the present invention is to provide a medicament delivery device which is used in combination with a key shaft and housing for the same that is easily transportable.

Another object of the present invention is to provide a medicament delivery device which is usable in medical emergencies situations such as heart attacks and strokes.

A further object of the present invention is to provide a medicament delivery device which may be part of a key mechanism used to operate a vehicle.

Yet another object of the present invention is to provide a medicament delivery device which is easily manufactured and is reliable in its usage.

The invention possesses other objects and advantages especially as concerns particular characteristics and features thereof which will become apparent as the specification continues.

For a better understanding of the invention reference is made to the following detailed description of the preferred embodiments of the invention which should be taken in conjunction with the above described drawings.

DETAILED DESCRIPTION OF THE PREFERRED EMBODIMENTS OF THE INVENTION

Various aspects of the present invention will evolve from the following detailed description of the preferred embodiments thereof which should be referenced to the prior described drawings.

Figure 2:
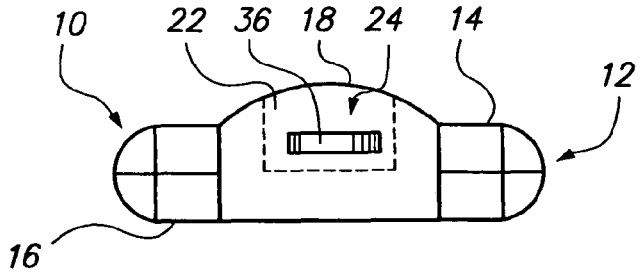
FIG. 2 is a right side end view of the device of the present invention.

An embodiment of the invention as a whole is depicted in the drawings by reference character 10. The device 10 includes as one of its elements a housing 12. Housing 12 is formed with a top 14 and a bottom 16. Ridge 18 may also be included on the outer portion of top 14 for the sake of gripping and handling of housing 12. In addition, housing 12 includes a wall portion 20 which is provided with a weakened zone 22, FIGS. 2, 3, and 4. Wall portion 20 forms a chamber 23, FIG. 3, which is enclosed when top 14 is connected to bottom 16 during the construction of housing 12. Again, housing 12 may be formed of any suitable material, such as plastic, metal, rubber, wood, and the like.

Device 10 is also provided with a key shaft 24. Key shaft is fashioned with a first end portion 26 and a second end portion 28. First end portion 26 of key shaft 24 is accessible outside the confines of housing 12 and chamber 23. First end portion 26 of key shaft 24 also includes the necessary shapes and cuts 30 to operate a lock, such as a lock found in a vehicle, dwelling, and the like. Second end portion 28 of key shaft 24 has a section 32 which lies within chamber 23. Section 32 of second end portion 28 of key shaft 24 lies adjacent weakened zone 22 of wall portion 20. In this regard, line 34, FIG. 3, indicates the end of second end portion 28 of key shaft 24 in one embodiment of the invention. Needless to say, the embodiments depicted in the drawing, also illustrate that second end portion 28 of key shaft 24 includes an end 36 which extends outside of chamber 23 and the confines of housing 12. End 36 is also formed with an aperture 38 which may be employed to connect device 10 to a key ring or the like, (not shown). Most importantly, it must be realized that key shaft 24 is positioned to housing 12 such that a force on key shaft 24, arrow 40 of FIG. 3, will separate and move key shaft 24 away from housing 12, arrow 42 FIG. 3.

Figure 1:
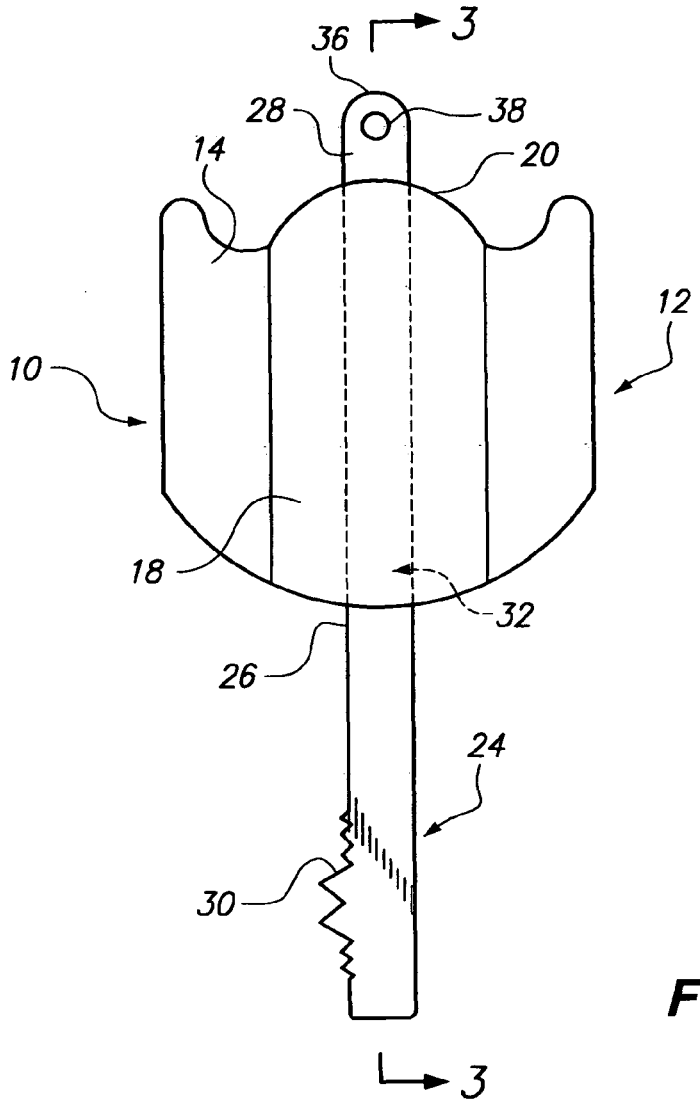
FIG. 1 is a top plan view of the device of the present invention.
Figure 3:
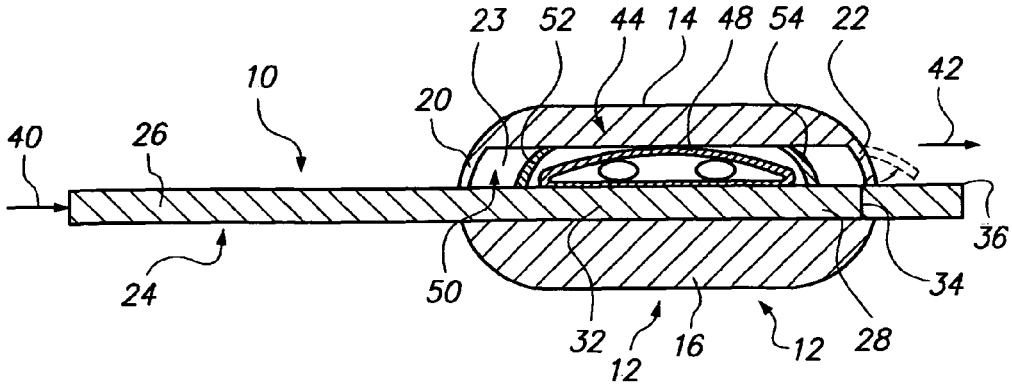
FIG. 3 is a sectional view taken along line 3-3 of FIG. 1.
Figure 4:
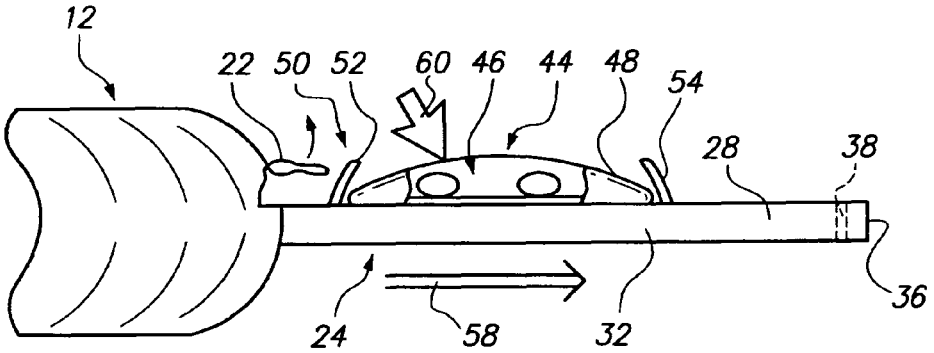
FIG. 4 is a partial side elevational view of the device of the present invention illustrating the movement of the key shaft and capsule from the inner chamber of the housing.
Figure 5:
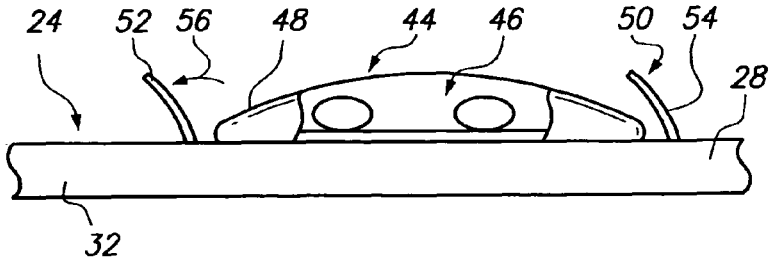
FIG. 5 is a partial side view of the device of the present invention showing the rotatable operation of a flange lying adjacent the capsule of the device of the present invention.

Holder 44 is also found in the present invention and is used to store medicament 46, which is depicted as a pair of pills in FIGS. 3-5. Holder 44 is supported by or connected to section 32 of second portion 28 of key shaft 24. That is to say, holder 44 lies inside chamber 23 of housing 12 in the initial configuration of device 10 depicted in FIGS. 1-3. Holder 44 may take the form of a frangible capsule 48. A retainer 50 is also employed to stabilize holder 44 within chamber 23. Retainer 50 is shown as a pair of flanges 52 and 54, FIGS. 3-5. It should be noted that flange 52 is rotatable according to directional arrow 56, FIG. 5.

In operation, device 10 is assembled such that top 14 and bottom 16 separably sandwich key shaft 24 therebetween. Key shaft 24 is held in this position to avoid relative movement between key shaft 24 and housing 12, during normal usage of device 10 in locking and unlocking operations. However, a predetermined force, directional arrow 40 of FIG. 3, will separate key shaft 24 from housing 12 to permit a sliding relationship. At this juncture first end portion 26 extends from housing 12 of device 10 and second portion 28 of key shaft 24 lies at least partially within chamber 23. In other words, section 32 of second portion 28 of key shaft 24 lies within chamber 23. A holder 44, in the form of a capsule 48, contains medicament 46. Holder 44 is motion stabilized within chamber 23 by retainer 50 in the form of flanges 52 and 54, FIGS. 3-5. Second portion 28 of key shaft 24 lies adjacent weakened zone 22 of wall portion 20, forming chamber 23 in housing 12. If one wishes to gain access to medicament 46 within capsule 48, a force is applied to first end portion 26 of key shaft 24, directional arrow 40 on FIG. 3, to move or slide key shaft 24 relative to housing 12, directional arrow 42. With reference to FIG. 4, it may be observed that capsule 48 has exited chamber 23 of housing 12 and has moved according to directional arrow 58. At this point the user may penetrate capsule 48, force arrow 60, and open the same. FIG. 5 depicts capsule 48 being opened with access to medicament 46 therewithin. It should also be seen that flange 52 of retainer 50 has been rotated to allow easy access to capsule 48. It should be noted that key shaft 24 or retainer 48 may cause the breakage of weakened zone 22 of wall 20 to allow the egress of capsule 48 from chamber 23, heretofore described. Device 10 may be hung on a key chain by the use of aperture 38 at end 36 of second end portion 28 of key shaft 24, to further convenience the user.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A medicament delivery device, comprising:

a. a housing said housing including a chamber formed by a wall portion said wall portion further including a weakened zone;

b. a key shaft said key shaft including a first end portion, and a second end portion, said key shaft first end portion being accessible outside said housing chamber said key shaft second end portion lying adjacent said weakened zone of said wall portion forming said chamber wall portion, said second end portion of said key shaft being at least partially positioned in said housing chamber;

c. a holder, said holder being connected to said key shaft second end portion and lying in said housing chamber said holder including a retainer for the medicament, said shaft being moved through said weakened zone of said wall portion upon the application of force on said key shaft, said movement of said key shaft causing egress of said holder from said housing chamber for access to said holder.

2. The device of claim 1 in which said holder retainer comprises a capsule, said capsule being breakable.

3. The device of claim 2 in which said capsule is formed of translucent material.

4. The device of claim 1 which further comprises one flange, said one flange lying adjacent said capsule.

5. The device of claim 4 which further comprises another flange, said another flange lying adjacent said capsule.

6. The device of claim 5 in which said another flange is rotatable.

7. The device of claim 1 in which said key shaft second end portion further comprises an end that extends outside said chamber and said housing.

8. The device of claim 7 in which said key shaft second end portion end includes an aperture.

9. The device of claim 7 in which said holder retainer comprises a capsule, said capsule being breakable.

10. The device of claim 9 in which said capsule is formed of translucent material.

11. The device of claim 7 which further comprises one flange, said one flange lying adjacent said capsule.

* * * * *